United States Patent [19]

Takagi et al.

[11] Patent Number: 4,486,058

[45] Date of Patent: Dec. 4, 1984

[54] POWER SOURCE TERMINAL ASSEMBLY

[75] Inventors: Yasumasa Takagi, Kawasaki; Tomohico Sasaki, Sagamihara; Tadanobu Matsumura, Machida; Tadashi Gobuichi, Kawasaki, all of Japan

[73] Assignee: Fujitsu Limited, Kawasaki, Japan

[21] Appl. No.: 418,009

[22] Filed: Sep. 14, 1982

[30] Foreign Application Priority Data

Sep. 18, 1981 [JP] Japan ..... 56-148079

[51] Int. Cl.[3] ..... H01R 4/66

[52] U.S. Cl. ..... 339/14 R; 339/126 R; 339/132 B; 339/198 R

[58] Field of Search ..... 339/125 R, 126 R, 132 R, 339/132 B, 198 R, 198 E, 133 R, 134, 14 R

[56] References Cited

U.S. PATENT DOCUMENTS

| | | | |
|---|---|---|---|
| 1,741,723 | 12/1929 | Le Fever | 339/132 R |
| 1,768,422 | 6/1930 | Russell et al. | 339/132 R |
| 1,813,716 | 7/1931 | Thordarson . | |
| 1,984,036 | 12/1934 | Schwartzmann | 339/198 E |
| 3,167,608 | 1/1965 | Mason | 339/198 E |
| 3,335,387 | 8/1967 | Mueller | 339/125 R |
| 3,548,360 | 12/1970 | Schlueter | 339/126 R |
| 4,161,622 | 7/1979 | Drayer et al. | 339/126 R |

FOREIGN PATENT DOCUMENTS

| | | | |
|---|---|---|---|
| 965510 | 5/1957 | Fed. Rep. of Germany . | |
| 1186123 | 1/1965 | Fed. Rep. of Germany . | |
| 1303520 | 8/1962 | France | 339/198 E |
| 275941 | 9/1951 | Switzerland . | |

*Primary Examiner*—John McQuade
*Assistant Examiner*—Gary F. Paumen
*Attorney, Agent, or Firm*—Staas & Halsey

[57] ABSTRACT

A power source terminal assembly for the wiring of electronic instruments, in which a plurality of terminal screw rods, each having a central flange, are molded into an insulating substrate with the flanges partly embedded therein. At least one of the terminal screw rods is designed so that one side of the flange projects outwardly from the substrate surface by a predetermined amount, and this terminal screw rod is used as a grounding terminal. A casing of an electronic instrument has a hole, for receiving the grounding terminal screw rod to permit one side of its flange to make contact with the casing, and a window for insertion of the other terminal screw rods without making contact with the casing. The power source terminal assembly is engaged with the casing, and the grounding terminal and one portion of the power source assembly are fixedly retained by fixing means to the casing.

11 Claims, 6 Drawing Figures

POWER SOURCE TERMINAL ASSEMBLY

BACKGROUND OF THE INVENTION

The present invention relates to a power source terminal assembly which is packaged in a casing of an electronic instrument for power supply and grounding as well.

On the side wall of an electronic instrument casing there are usually disposed side by side a power source terminal assembly for relaying power source circuits inside and outside of the casing and a grounding terminal.

A conventional structure of this kind is shown in FIGS. 1 and 2, which are respectively a front view and a plan view, partly in section. As illustrated in FIGS. 1 and 2, connectors for relaying crimp-style terminals 1, each attached to a wire end, are constituted by conductor screw rods 3*a* and 3*b*, each carrying at opposite end portions thereof pluralities of washers and conductor nuts 2 firmly gripping therebetween the crimp-style terminals 1. The screw rod 3*a* of the grounding terminal is inserted into a hole made in a casing side wall 4 at a predetermined position and clamped by washers and nuts 6 to the side wall 4. The screw rods 3*b* of the power source terminals are inserted into holes in a rectangular insulating substrate 7 and fastened thereto by the same method as in the case of the screw rod 3*a*, thus forming a power source terminal assembly. The substrate 7 of the power source terminal assembly is mounted on the side wall 4 to cover a window made therein in side-by-side relation to the hole 5 and is fastened by tightening its four corners with small screws 9 to the side wall 4.

With such a conventional structure, the mounting of the terminal screw rods and the substrate involves nut tightening at six places and screw tightening at four places as described above; namely, a large amount of time for mounting is required. At the same time, since the grounding terminal is retained to the side wall of the casing at one point, the casing is apt to be damaged by an external force, for instance, when the grounding wire is pulled.

SUMMARY OF THE INVENTION

It is therefore an object of the present invention to reduce the large amount of time for mounting of the terminal screw rods and the substrate.

Another object of the present invention is to prevent damage to the casing side wall which is caused by an external force applied to the terminal screw rod of the grounding terminal.

These and other objects and advantages of the present invention will become more apparent by referring to the following detailed description and accompanying drawings.

DETAILED DESCRIPTION OF THE PREFERRED EMBODIMENTS

A detailed description will hereinafter be given, with reference to FIGS. 3 to 6, of the present invention.

Figure 1:
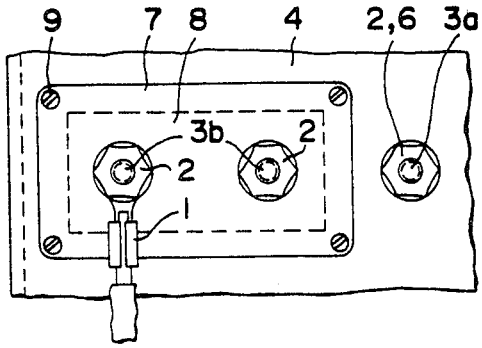
FIG. 1 (PRIOR ART)
FIG. 1 is a front view showing a conventional structure.
Figure 3:
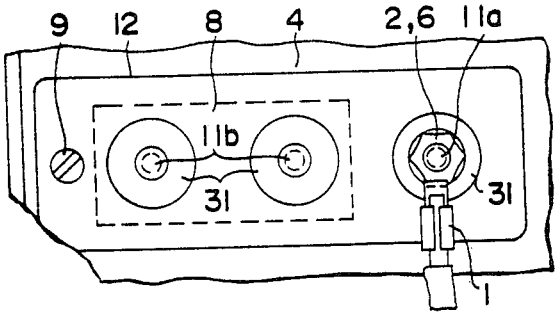
FIG. 3 is a front view illustrating the power source terminal assembly of the present invention.
Figure 4:
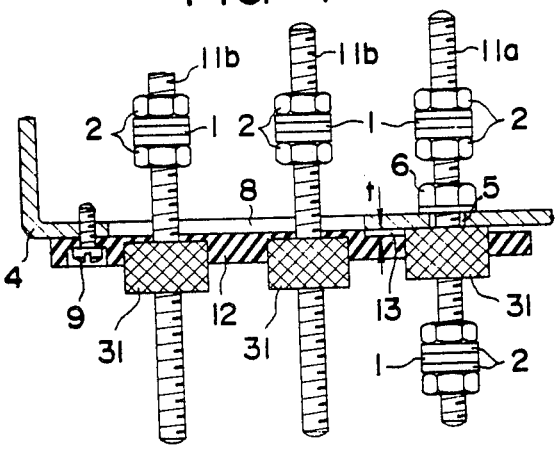
FIG. 4 is a plan view of the power source terminal assembly of the present invention.

FIG. 3 is a front view showing the assembled state of the power source terminal assembly of the present invention and FIG. 4 is a plan view of FIG. 3, partly in section. In FIGS. 3 and 4, the parts corresponding to those in FIG. 1 are identified by the same reference numerals.

Figure 2:
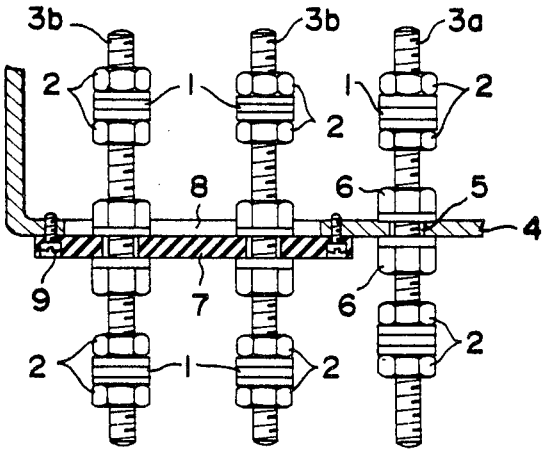
FIG. 2 (PRIOR ART)
FIG. 2 is a plan view, partly in section, of the structure shown in FIG. 1.

In FIGS. 3 and 4, reference numeral 11*a* indicates a terminal screw rod of a grounding terminal; and 11*b* designates the terminal screw rods of the power source terminals, each of which rods carries at one of its end portions washers (as illustrated) and nuts 2 for firmly gripping the crimp-style terminal 1. FIGS. 3 and 4 show the terminal screw rods 11*b* without the lower washers 1 and nuts 2 shown in FIG. 2. The terminal screw rods 11*a* and 11*b* each have a centrally located knurled flange 31, which is formed as a unitary structure therewith. The terminal screw rods 11*a* and 11*b* are molded into an insulating substrate 12 with their flanges 31 partly embedded in the substrate 12. In the vicinity of a terminal screw rod 11*a* on the back of the substrate 12 there is formed a step-shaped recess 13 which extends to one side of the substrate 12, permitting one side of the flange 31 of the terminal screw rod 11*a* to project out on the back of the substrate 12 by the depth t of the recess 13. The depth t of the recess 13 is selected so that one side of the flange 31 may abut against the side wall 4 regardless of whether the molded substrate has a burr on the side of the recess 13.

As described above, according to the present invention, the screw rods of all the terminals including the grounding terminal are molded into a common substrate and the flange of the screw rod of the grounding terminal is disposed at such a position as mentioned above. Accordingly, the power source terminal assembly of the present invention differs in this point from the prior art structure in which the grounding terminal is isolated from the substrate.

In the case of mounting the power source terminal assembly of such a structure to a casing, the terminal screw rods 11*a* and 11*b* molded into the substrate 12 are inserted into the hole 5 and window 8 of the side wall 4, the terminal rod 11*a* is clamped by tightening the nut 6 to the side wall 4, and then the other end portion of the substrate 12 is fastened by a machine screw 9 to the vicinity of the window 8 of the side wall 4. Thus the terminal screw rod 11*a* has one side of its flange 31 abutting against the side wall, and hence performs the function of the grounding terminal, but the terminal screw rods 11*b* of the power source terminals stay in the window 8 and, consequently, they are out of contact with the side wall 4. The crimp-style terminals connected to wire ends are fastened by the washers and nuts 2 mounted on both sides of each terminal screw rod, to perform the wiring.

As described above, the power source terminal assembly of the present invention can be mounted by the tightening of one nut and one screw, and further it is assured that the grounding terminal makes contact with the casing. In addition, the grounding terminal is molded into the substrate 12. Accordingly, the present invention provides for enhanced efficiency in the mounting operation and improved reliability of the wiring. Further, the present invention ensures that the grounding terminal is firmly retained against the side wall 4.

Figure 5:
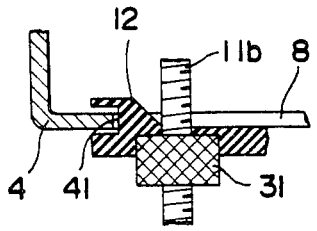
FIG. 5 is a diagram showing an example of means for fixing the marginal edge of the insulating mold substrate of the power source terminal assembly of the present invention.

FIG. 5 shows another means for fixing the substrate 12. In this case, one end portion of the substrate 12 is retained against the side wall 4 by fastening thereto the terminal rod 11*a* as in the above case, but the other end portion of the substrate 12 is retained against the side wall 4 by engaging at least a marginal portion of the side wall at the window 8 with a guide groove 41 that is cut in the edge of the other end portion of the substrate 12. With this structure, fastening of the machine screw 9 is unnecessary, thus permitting further reduction of the time for mounting.

Figure 6:
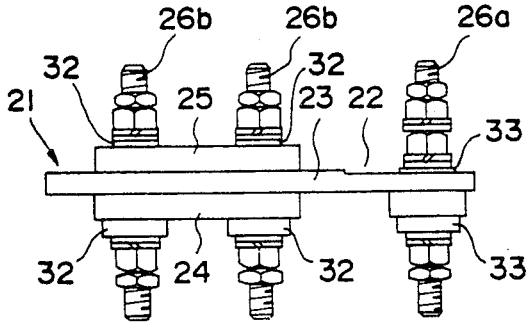
FIG. 6 is a plan view illustrating a modified form of the power source terminal assembly of the present invention.

FIG. 6 illustrates a modification of the present invention. In this embodiment, a molded insulating substrate 21 is formed by a mounting plate 23 having a recess 22 as in the foregoing embodiment and projections 24 and 25 on both sides thereof, and the terminal screw rods 26*b* of the power source terminal are disposed to extend through the substrate 21 and the projections 24 and 25 formed integrally therewith. Both sides of the flanges 32 of the terminals screw rods 26*b* project out of the projections 24 and 25, and crimp-style terminals (not shown) connected to wire ends are fastened to the end faces of the flanges 32 with nuts inside and outside the casing to perform the power source wiring. In this case, since the wiring is carried out in such a state that the wires are separated by the projections 24 and 25 from the casing side wall, the crimp-style terminals do not get in contact with the side wall. Furthermore, since the both end faces of the flanges 32 project out of the projections 24 and 25, a plurality of wires can be connected by two crimp-style terminals which are disposed back to back with respect to each other. A terminal screw rod 26*a* of the grounding terminal is disposed to extend through the recessed portion of the mounting plate 23 in the same manner as in the foregoing embodiment. Reference numeral 33 indicates a flange of the terminal screw rod 26*a*. Incidentally, this power source terminal block is mounted on the casing by fastening a nut of the terminal screw rod 26*a* inserted through a hole made in the side wall and engaging the projection 25 with the window in the side wall.

The structure of this embodiment allows more ease in wiring than does the foregoing embodiment.

While the foregoing embodiments have been described in connection with the case of two power source terminals being used as in the case of single-phase 100 V receiving terminals, the present invention is also applicable to the case of using three power source terminals for three-phase power receiving use.

As has been described in the foregoing, the present invention produces the following excellent effects:

1. Since the terminal screw rods are assembled with a common molded insulating substrate, and since the terminal block is mounted to the casing only by fastening the terminal screw rod of the gounding terminal with a nut and retaining one end portion of the substrate by fixing means such as one screw, the efficiency of the mounting operation can be improved and the grounding terminal can be firmly retained to the casing side wall, thus ensuring that the grounding terminal is prevented from being damaged by an external force applied thereto; and 2. When the terminal screw rod of the grounding terminal is fastened to the side wall, one side of the flange of the terminal screw rod makes contact with the side wall, thus ensuring the contact of the grounding terminal with the casing.

It will be apparent that many modifications and variations may be effected without departing from the scope of the novel concepts of the present invention.

What is claimed is:

1. A power source terminal assembly, to be mounted in a window of a casing of an electronic instrument, comprising a plurality of terminal screw rods, each said terminal screw rod having a central flange, and an insulating substrate into which said terminal screw rods are molded, with said flanges partly embedded in said substrate, wherein at least a first one of said terminal screw rods is used as a grounding terminal and is formed so that a first side of its flange projects outwardly of the surface of said substrate by a predetermined amount for contacting said casing.

2. The assembly of claim 1, said casing having a hole, comprising said first terminal screw rod being inserted into said hole in said casing to permit said first side of its flange to abut against the casing, the other terminal screw rods being located in said window without making contact with said casing, said insulating substrate being engaged with the casing, and fixing means for retaining said first side of said flange of said grounding terminal and one end portion of said insulating substrate to said casing.

3. The assembly of claim 1, comprising said insulating substrate having a portion with a groove, wherein said portion of said substrate projects through said window, and a portion of an edge of said window in said casing is retained in said groove.

4. The assembly of claim 2, comprising said insulating substrate having a portion with a groove, wherein said portion of said substrate projects through said window, and a portion of the edge of said window in said casing is retained in said groove.

5. The assembly of claim 3, said fixing means consisting of said portion with said groove and a nut and washer on one end of said first terminal screw rod used as said grounding terminal, wherein said flanges of all said terminal screw rods except said first terminal screw rod project from the opposite side of said insulating substrate than the side from which said first side of said flange of said first terminal screw rod projects.

6. The assembly claim 4, said fixing means consisting of said portion with said groove and a nut and washer on one end of said first terminal screw rod.

7. The assembly of claim 1, said insulating substrate having at least one projection through which project said flanges of all but said first terminal screw rod.

8. The assembly of claim 5, said insulating substrate having at least one projection through which project said flanges of all but said first terminal screw rod.

9. The assembly of claim 1, wherein the surface of said insulating substrate in the vicinity of said first side of said flange of said first terminal screw rod does not contact said casing.

10. The assembly of claim 2, wherein the surface of said insulating substrate in the vicinity of said first side of said flange of said first terminal screw rod does not contact said casing.

11. The assembly of claim 1, wherein said flanges of all said terminal screw rods except said first terminal screw rod project from the opposite side of said insulating substrate than the side from which said first side of said flange of said first terminal screw rod projects.

* * * * *

UNITED STATES PATENT AND TRADEMARK OFFICE

CERTIFICATE OF CORRECTION

PATENT NO. : 4,486,058

DATED : 4 December 1984

INVENTOR(S) : Yasumasa Takagi et al

It is certified that error appears in the above-identified patent and that said Letters Patent is hereby corrected as shown below:

Column 2, line 23, "llb" should be --lla and llb--.

Signed and Sealed this

*Thirtieth* Day of *July 1985*

[SEAL]

*Attest:*

DONALD J. QUIGG

*Attesting Officer* *Acting Commissioner of Patents and Trademarks*